United States Patent [19]

Ohfusa

[11] Patent Number: 4,799,515

[45] Date of Patent: Jan. 24, 1989

[54] WOVEN SLIDE FASTENER STRINGER

[75] Inventor: Masaatsu Ohfusa, Kurobe, Japan

[73] Assignee: Yoshida Kogyo K. K., Tokyo, Japan

[21] Appl. No.: 138,362

[22] Filed: Dec. 28, 1987

[30] Foreign Application Priority Data

Dec. 27, 1986 [JP] Japan ..... 61-199532[U]

[51] Int. Cl.[4] ..... A44B 19/40

[52] U.S. Cl. ..... 139/384 B; 24/392

[58] Field of Search ..... 139/384 B; 24/392, 393

[56] References Cited

U.S. PATENT DOCUMENTS 4,254,803 3/1981 Tsubata ..... 139/384 B

*Primary Examiner*—Henry Jaudon

*Attorney, Agent, or Firm*—Hill, Van Santen, Steadman & Simpson

[57] ABSTRACT

In a woven slide fastener stringer in which a gap-filling warp thread extends under successive loops of a coiled plastic filament and alternately over and under picks of a foundation weft thread so as to pull portions of the foundation weft thread between the outermost upper binding warp thread and the next upper binding warp thread toward the lower side of the tape substantially halfway between the upper and lower legs of the respective loops, at least one pair of space-retaining warp threads is disposed between the outermost upper binding warp thread and the next upper binding warp thread. The space-retaining warp threads extend alternately over and under the upper and lower legs of the successive filament loops so as to clamp the individual loops, thus keeping the latter in proper upright posture and free from staggering pitch.

3 Claims, 4 Drawing Sheets

WOVEN SLIDE FASTENER STRINGER

BACKGROUND OF THE INVENTION

1. Field of the Invention

The present invention relates to a slide fastener, and more particularly to a woven fastener stringer having a coiled continuous plastic filament woven into a longitudinal edge of a woven tape simultaneously with the wearing of the tape.

2. Description of the Prior Art

There have been proposed a number of slide fasteners of the type in which a row of fastener elements is woven into one longitudinal edge of a woven stringer tape simultaneously with the wearing of the tape. Usually the fastener element row is in the form of a helically coiled continuous plastic filament having a succession of loops.

In production, when it is bent into such a helical shape, the filament which is thicker and harder than the warp and weft yarns of the tape tends to yield back under its own resilience, thus not only causing the fastener stringer to stretch longitudinally but also causing the individual filament loops to tilt away from a proper upright posture with respect to the plane of the tape. This would result in staggering pitch of the filament loops, i.e. the fastener elements, which would hinder smooth closing and opening operation of the slide fastener.

A solution is disclosed in U.S. Pat. No. 4,623,004 for making the fastener stringer stable in the loop-to-loop pitch of the filament. According to this prior art, as shown in FIG. 5, the outermost upper and lower binding warp threads A, B extend respectively over and under the loops E and are disposed substantially in registry with one another, and a gap-filling warp thread C is laid between the outermost upper binding warp thread A and the next upper binding warp thread Al and extends under the loops E and alternately over and under the picks of a foundation weft thread D so as to pull the portions of the foundation weft thread D between the outermost upper binding warp thread A and the next upper binding warp thread Al toward the opposite side of the tape substantially halfway between the upper and lower legs of the respective loops E. A problem with this prior art arrangement is that the positions at which the gap-filling warp thread C is interlaced with the foundation weft thread D can be easily changed as affected by possible small changes in tension of the warp and weft threads and/or in properties of the material of the filament. As a result, reliable and accurate shaping of the filament loops is difficult to achieve.

SUMMARY OF THE INVENTION

It is therefore an object of the present invention to provide a woven slide fastener stringer in which a plastic filament shaped into a continuous row of helically coiled loops can be woven into one longitudinal edge of a woven stringer tape stably without being misshaped as affected by possible small changes in tension of warp and weft threads of the tape and/or properties of the material of the filament. Therefore, the filament loops are normally kept in proper upright posture and free from staggering pitch.

According to the present invention, in a woven slide fastener stringer in which a gap-filling warp thread extends under the loops and alternately over and under the picks of a foundation weft thread so as to pull the portions of the foundation weft thread between the outermost upper binding warp thread and the next upper binding warp thread toward the lower side of the tape substantially halfway between the upper and lower legs of the respective loops, at least one pair of space-retaining warp threads is disposed between the outermost upper binding warp thread and the next upper binding warp thread. The space-retaining warp threads extend alternately over and under the upper and lower legs of the successive filament loops so as to clamp the individual loops.

Other advantages, features and additional objects of the present invention will become manifest to those versed in the art upon making reference to the detailed description and the accompanying sheets of drawings in which preferred structural embodiments incorporating the principle of the present invention are shown by way of illustrative example.

DETAILED DESCRIPTION

Figure 1:
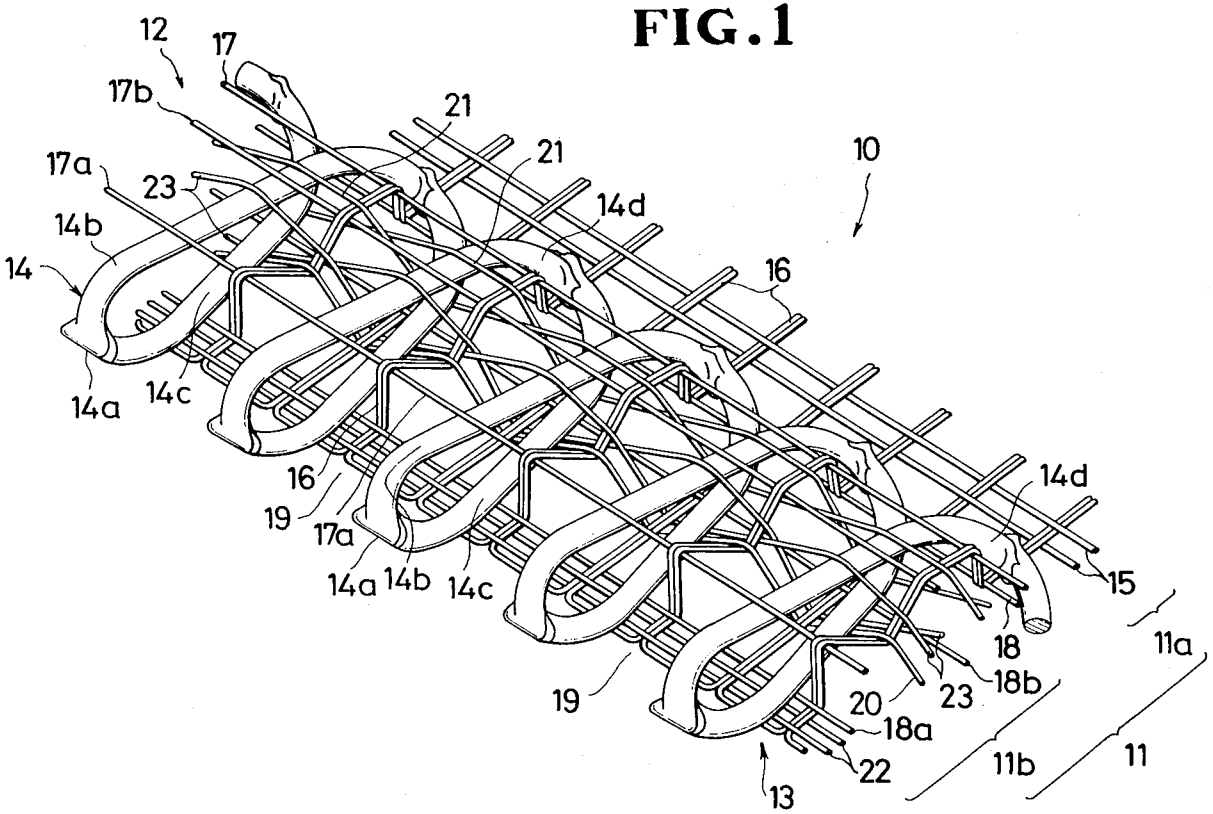
FIG. 1 is a fragmentary perspective view of a woven slide fastener embodying the present invention.
Figure 2:
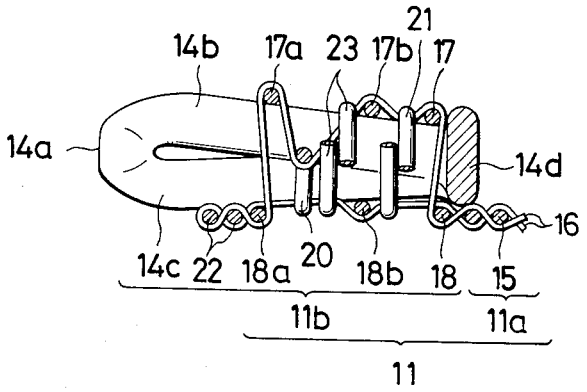
FIG. 2 is an enlarged transverse cross-sectional view of FIG. 1.

As shown in FIGS. 1 and 2, a slide fastener stringer 10 constitutes one part of a pair of identical stringers for a slide fastener. The stringer 10 generally includes a woven tape 11 having a substantially flat web section (only partly shown) **11*a* defining a major portion of the tape 11 and a filament woven section 11*b* defining a longitudinal edge portion 12 of the tape into which a synthetic resin filament 13, preferably a monofilament of polyester, is laid in double pick and is woven in the shape of a helical coil having a row of successive loops 14** each serving as a fastener element.

Each loop 14 of the filament 13 has a coupling head **14*a* at one end thereof, upper and lower legs 14*b*, 14*c* extending from the head 14*b* in a common direction, and a heel portion 14*d* remote from the coupling head 14*a* and connecting the upper leg 14*b* of each loop 14 and the lower leg 14*c* of the next loop 14. The coupling head 14*a* is dimensioned so as to be releasably coupled with a corresponding head of a loop 14** on a mating stringer to open and close the slide fastener in a well known manner.

The web section **11*a* of the tape 11 is woven of a plurality of foundation warp threads 15 and a foundation weft thread 16. The structure of the web section 11*a*** is not relevant to the invention, and therefore its detailed description is omitted here for clarity.

The filament woven section **11*b* of the tape 11 includes a group of upper binding warp threads 17 extending in parallel longitudinally of the tape 11 and overlying the upper legs 14*b* of the successive filament loops 14 and a group of lower binding warp threads 18 extending in parallel longitudinally of the tape 11 and underlying the lower legs 14*c* of the successive loops 14, both groups of binding warp threads 17, 18 running as a whole substantially along a straight path at the region of the legs 14b, 14c which extends substantially from the midportion of each of the upper and lower legs 14b, 14c to the heel portions 14d. The foundation weft thread 16 is laid in double pick and is interwoven with the foundation warp threads 15 to form the web section 11a. In the filament woven section 11b, the foundation weft thread 16 interwoven with the upper and lower binding warp threads 17, 18 to form loops in the spaces between the adjacent loops 14, i.e. in the successive inter-loop spaces 19**.

A gap-filling warp thread 20 is disposed between a first or outermost upper binding warp thread 17a and a second or next upper binding warp thread 17b and also between a first or outermost lower binding warp thread 18b, and extends under the lower legs 14c of the filament loops 14 and alternately over and under the picks of the foundation weft thread 16. The foundation weft thread 16 is tensioned by the gap-filling thread 20. Since the gap-filling warp thread 20 underlies the lower legs 14c and the foundation weft thread 16, but does not overlie the upper legs 14b, upper portions of the respective loops of the foundation weft thread 16 in the inter-loop spaces 19 are drawn to sink substantially halfway between the upper and lower legs 14b, 14c of the respective filament loops 14, as best shown in FIG. 2. As a result, the spaces 19 between adjacent loops 14 are closed to some extent to retain all the loops 14 substantially in an upright posture with respect to the plane of the tape 11.

The first upper binding warp thread 17a is disposed substantially in registry with the corresponding first lower binding warp thread 18a so that the portions 16a of the foundation weft thread 16 which span between these binding warp threads 17a, 18a are oriented to lie substantially perpendicularly to the plane of the tape 11, thereby clearly defining an open area required for smooth and accurate coupling engagement of the coupling heads 14a of the filament loops 14 of the opposed stringers 10, 10.

A plurality of loop-clamping warp threads (two in the illustrated embodiment) 21 are disposed between the second upper binding warp thread 17b and the third or next upper binding warp thread 17 and also between the second lower binding warp thread 18b and the third or next lower binding warp thread 18 for clamping the successive loops 14 of the filament 13 in place against displacement which would otherwise take place when the bending or other external stresses are exerted on the slide fastener. The loop-clamping threads 21 extend alternately over the upper leg 14b of the respective loop 14 and the foundation weft thread 16 and under the lower leg 14c of the next loop 14 and the foundation weft thread 16 so as to be interwoven in a pattern of 1/1 with the filament 13 and in a pattern of 2/2 with the foundation weft thread 16. As better shown in FIG. 2, the loop-clamping warp threads 21 bring the upper and lower legs 14b, 14c of each filament loop 14 closely together so that the loops 14 may assure a stable posture with respect to the tape 11. Thus each pair of loop-clamping warp threads 21 extend in a symmetric pattern.

A plurality of anchoring warp threads (two in the illustrated embodiment) 22 underlie the lower legs 14c of the filament loops 14 adjacent to the coupling heads 14a and are interwoven with the foundation weft thread 16 for anchoring the filament loops 14 to prevent the latter from leaning downwardly away from the plane of the tape 11.

Most important, a pair of space-retaining warp threads 23 is disposed between the first and second upper binding warp threads 17a, 17b and also between the first and second lower binding warp threads 18a, 18b for keeping the inter-loop spaces 19 in proper dimensions. The space-retaining warp threads 23 extend alternately over the upper leg 14b of the respective filament loop 14 and the foundation weft thread 16 and under the lower leg 14c of the next loop 14 and the foundation weft thread 16 so as to be interwoven in a pattern of 1/1 with the filament 13 and in a pattern of 2/2 with the foundation weft thread 16. As better shown in FIG. 2, the space-retaining warp threads 23 bring the upper and lower legs 14b, 14c of each filament loop 14 closely together so that the loops 14 assure a stable posture with respect to the tape 11. Further, the two space-retaining warp threads 23 extend in a symmetric pattern.

With the space-retaining warp threads 23, since the points of interlacing of the gap-filling warp thread 20 and the foundation weft thread 16 are located uniformly between the successive inter-loop spaces 19, the filament 13 can be woven into the tape with an increased degree of stableness without being misshaped as affected by possible small changes in tension of the warp and weft threads of the tape and/or properties of the material of the filament. Therefore, the filament loops 14 are normally kept in proper upright posture and free from staggering pitch.

Figure 4:
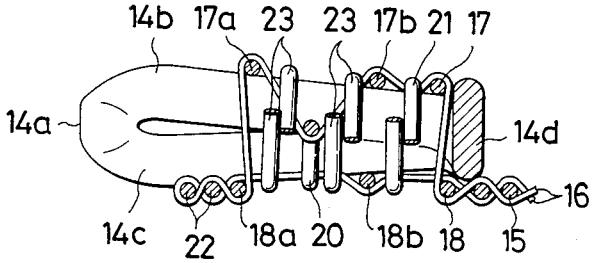
FIG. 4 is an enlarged transverse cross-sectional view of FIG. 3.
Figure 3:
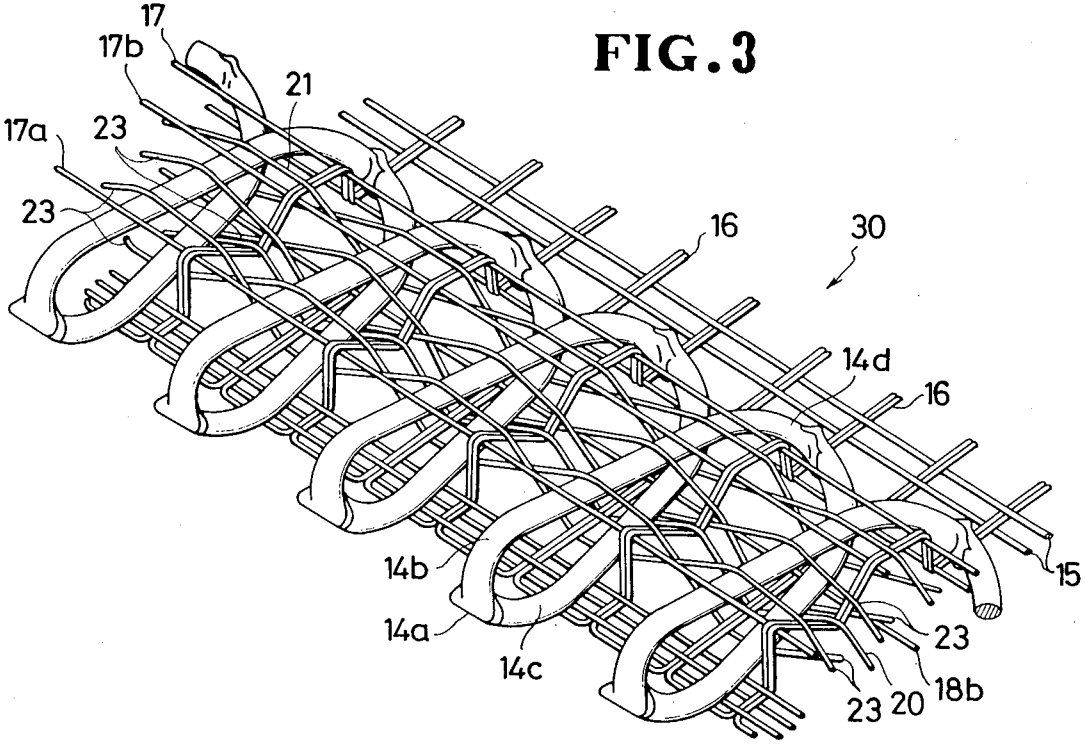
FIG. 3 is a view similar to FIG. 1, but showing a modified woven slide fastener stringer.
Figure 5:
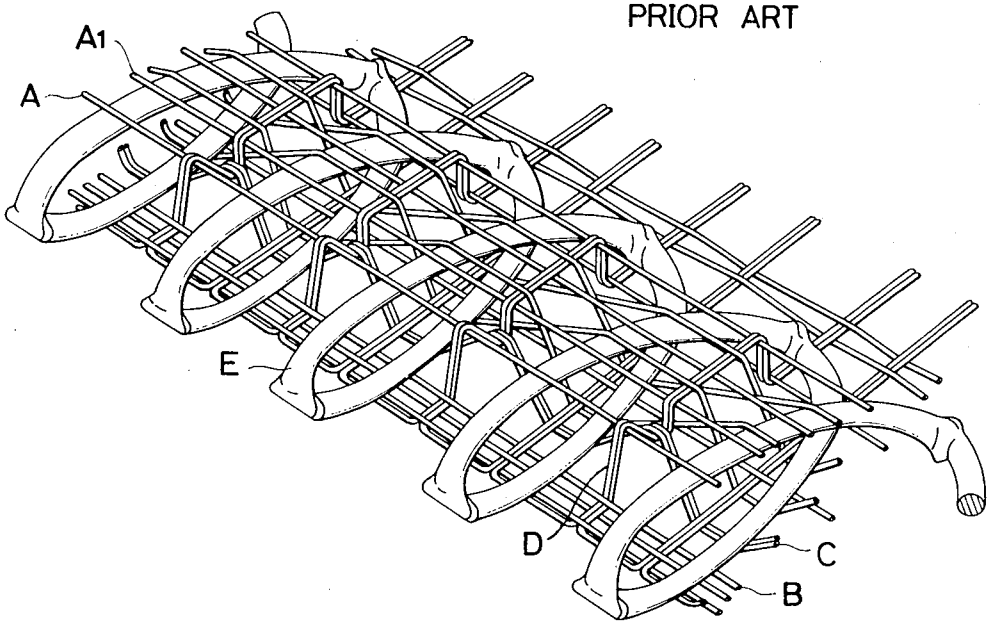
FIG. 5 PRIOR ART
FIG. 5 is a fragmentary perspective view of a woven slide fastener stringer according to the prior art.

FIGS. 3 and 4 show a modified slide fastener stringer 30 which is resemblant to the stringer 10 of FIGS. 1 and 2 except that an additional pair of space-retaining warp threads 23 is inlaid between the first and second upper binding warp threads 17a, 17b and also between the first and second lower binding warp threads 18a, 18b in the same manner as the space-retaining warp threads 23 in the stringer 10 of FIGS. 1 and 2. The two pairs of space-retaining warp threads 23, 23 and 23, 23 are symmetrical with respect to the gap-filling warp thread 20.

As it appears obvious from the scope of the appended claims and to those skilled in the art, there may be made various changes and modifications in the specific embodiments herein shown and described. For example, the number of the binding warp threads or the loop-clamping warp threads may be varied according to the size or the slide fastener.

What is claimed is:

1. A woven slide fastener stringer comprising:

(a) a tape woven of a plurality of foundation warp threads and a foundation weft thread and having a filament woven section defining a longitudinal edge portion;

(b) a continuous coil-shaped synthetic resin filament having a row of successive loops, each of said loops having a coupling head at one end thereof, upper and lower legs extending from the head in a common direction, and a heel portion remote from said coupling head and connecting said upper leg of each said loop and said lower leg of the next loop;

(c) a group of upper binding warp threads extending in parallel longitudinally of said tape and overlying said upper legs of said filament loops and interwoven with said foundation weft thread, and a group of lower binding warp threads extending in parallel longitudinally of said tape and underlying said lower legs of said filament loops and interwoven with said foundation weft thread, both said groups of binding warp threads running as a whole substantially along a straight path at the region which extends substantially from the midpoint of each of said upper and lower legs to said heel portions;

(d) a plurality of loop-clamping warp threads extending between said upper and lower binding warp threads and alternately overlying said upper legs and said foundation weft thread and underlying said lower legs and said foundation weft thread at every other adjacent loops;

(e) a gap-filling warp thread disposed between an outermost one of said upper binding warp threads and the next upper binding warp thread and also between an outermost one of said lower binding warp threads and the next lower binding warp thread and extending under said lower legs of said filament loops and alternately over and under said foundation weft thread so as to pull portions of said foundation weft thread between the outermost upper binding warp threads and the next upper binding warp thread toward a lower side of said tape substantially halfway between said upper and lower legs of the respective loops; and (f) a pair of space-retaining warp threads disposed between the outermost upper binding warp thread and the next upper binding warp thread and also between the outermost lower binding warp thread and the next lower binding warp thread and extending alternately over said upper leg of one of said filament loops and said foundation weft thread and under said lower leg of the next filament loop and said foundation weft thread so as to clamp said filament loops.

2. A woven slide fastener stringer according to claim 1, further including an additional pair of space retaining warp threads disposed between the outermost upper binding warp thread and the next upper binding warp thread and also between the outermost lower binding warp thread and the next lower binding warp thread and extending alternately over said upper leg of one of said filament loops and said foundation weft thread and under said lower leg of the next filament loop and said foundation weft thread so as to clamp said filament loops.

3. A woven slide fastener stringer according to claim 2, wherein the two pairs of space-retaining warp threads are symmetrical with respect to said gap-filling warp thread.

* * * * *